United States Patent [19]

Bratt

[11] 4,335,654

[45] Jun. 22, 1982

[54] ELECTRIC IGNITER

[75] Inventor: Sven-Erik Bratt, Karlskoga, Sweden

[73] Assignee: Aktiebolaget Bofors, Bofors, Sweden

[21] Appl. No.: 183,672

[22] Filed: Sep. 2, 1980

[30] Foreign Application Priority Data

Sep. 3, 1979 [SE] Sweden ..... 79072955

[51] Int. Cl.[3] ..... F42C 19/12

[52] U.S. Cl. ..... 102/202.8; 102/202.9; 102/202.12

[58] Field of Search ..... 102/202.1, 202.2, 202.4, 102/202.5, 202.7, 202.8, 202.9, 202.12

[56] References Cited

U.S. PATENT DOCUMENTS

| | | | |
|---|---|---|---|
| 2,987,951 | 6/1961 | Seavey et al. | 102/202.5 X |
| 3,135,200 | 6/1964 | Jackson | 102/202.9 |
| 3,175,492 | 3/1965 | Reyne et al. | 102/202.2 |
| 3,185,093 | 5/1965 | Holinbeck | 102/202.2 |
| 3,264,989 | 8/1966 | Rucker | 102/202.2 X |
| 3,298,306 | 1/1967 | Purdy | 102/202.8 |
| 4,103,619 | 8/1978 | Fletcher et al. | 102/202.5 |
| 4,271,453 | 6/1981 | Yajima et al. | 102/202.2 X |

FOREIGN PATENT DOCUMENTS 1488893 10/1977 United Kingdom .

*Primary Examiner*—Peter A. Nelson

*Attorney, Agent, or Firm*—Pollock, Vande Sande & Priddy

[57] ABSTRACT

The invention comprises an electric igniter comprising a filament (9), a priming charge ignitable by heat generated in the filament by feeding an electric current therethrough, two connection legs (8, 8') for connecting the feed wires (7, 7') to the igniter and the filament and a high frequency filter to protect the igniter against accidental ignition by electromagnetic fields or static electricity. The casing of the igniter comprises a wider part (2), the "cup", and a narrower part (3) in which narrower part (3) and the connection legs (8, 8') are cast in a material (10) which withstands pressure and high temperatures. The igniter has a simple mechanical design using capacitor and ferrite elements (11, 12) as the high frequency filter which elements are common for the two connection legs. The ferrite element (12) is located in the narrower part (3) of the igniter so that the element together with the material (10) serves as a bushing for the two connection legs.

4 Claims, 1 Drawing Figure

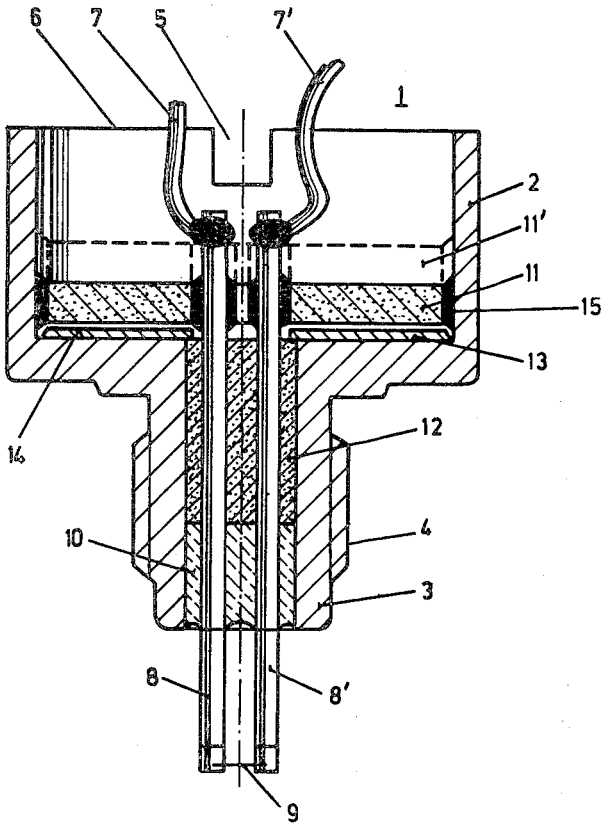
6
7
5
7'
1
2
11'
11
15
13
14
12
10
4
3
8
8'
9

ELECTRIC IGNITER

The present invention relates to an electric igniter comprising a filament, a priming charge ignitable by heat generated in the filament by feeding an electric current therethrough and a high frequency filter to protect the igniter against accidental ignition by electromagnetic fields or static electricity.

British Pat. No. 1,488,893 illustrates a previously known electric igniter of the above-mentiond kind. The igniter is specifically intended to start a rocket motor and constructed of a material capable of resisting puncture from the pressure and temperature which arises in the pressure vessel of the rocket motor. The igniter is further protected against accidental ignition from electromagnetic fields and static electricity by connecting the feed wires to the filament via high frequency filters. The feed wires are connected together with a nonlinear bipole connected in parallel with the high-frequency filters and the filament, and by connecting one of the feed wires to the casing. The igniter including the filters and the nonlinear bipole is encapsulated in a common metal casing.

A disadvantage with the igniter, however, is that a comparatively large space is required as all the electrical components are contained in a separate voluminous room or "cup" arranged on the igniter itself. Also, a great number of solder connections must be made for connecting the feed wires to the connection legs via the filters.

Even if one of the embodiments illustrated in the British Patent has a simpler mechanical design (coaxial type with only one connecting leg) this does not solve the problem of the mechanical design of an igniter having two separate connection legs.

The present invention relates to an electric igniter which, like the above-mentioned igniters, easily satisfies existing requirements as to safety against accidental ignition, but which igniter has a more simple and compact mechanical design compared with previously known igniters. The present igniter has a great advantage from the manufacturing point of view requiring fewer solder joints compared with the previously known type. Disc-shaped capacitor elements of a new type can be used which makes it easier to design the igniter for different applications.

According to the invention the electric igniter comprises two straght and parallel connection legs extending through the entire igniter for connecting the filament to the feed wires, and a high-frequency filter with a capacitor, and a ferrite element both of which are common for the two connection legs.

The electric igniter shown in the drawing consists of a cylindrical casing 1 of metal, for instance steel, in which the igniter is enclosed. Through this encapsulation, high frequency electromagnetic energy is shielded from the igniter, avoiding prematurely setting off the igniter. The casing is made with a wider part 2, the "cup", and a narrower part 3 provided with external threads 4 which together with a wrench grip 5 at the end closure of the cup 2 facilitates assembly of the igniter in the wall of the pressure vessel of a rocket motor or other devices.

The feed wires 7, 7' to the igniter pass in through the end closure 6 and are soldered on the connection legs 8, 8' of the filament 9, on which an ignition composition can be cast. The connection legs consist of two straight and parallel pin members which extend centrally through the cup as well as the narrower part of the casing.

In order to prevent the rocket motor from being punctured when the igniter is mounted directly in the pressure vessel of a rocket motor, the connection legs are cast in a bushing located in the narrower part 3 of the casing and made of a material 10, which withstands pressure and high temperatures, e.g. glass.

In order to prevent accidental ignition by electromagnetic energy which actuates the feed wires outside the igniter and in order to prevent the igniter from static electricity, the connection legs are provided with a high frequency filter which consists of a capacitor element 11 and a ferrite element 12 which enclose both of the connection legs.

In contrast to previously known electric igniters in which the connection legs or feed wires are provided with separate ferrite elements, only one ferrite element which is common for the two connection legs is used in our invention. This means that it is not necessary to locate the ferrite element in the cup 2 as previously. Instead, the element is located in the narrower part 3 of the casing to form, together with the material 10 which withstands pressure and high temperatures, a bushing for the two connection legs. As no space is occupied in the cup 2 of the casing, this part is used only for the capacitor elements 11 which means that the cup can be made smaller or, alternatively, provide room for additional capacitor elements 11' if required, indicated by dashed lines in the drawing.

The capacitor element 11 consists of a disc-shaped element with two centrally positioned holes for the two connection legs 8, 8' and is mounted on a seal ring, made for instance of teflon, resting on the surface 14 of the cup 2. Using this type of capacitor element means that the igniter can be easily designed for different applications simply by using a different number of capacitor elements mounted on each other in the cup. Using a capacitor element which is common for the two connection legs further means that the connection legs can be located more close to each other compared with the previous solution in which each of the connection legs is provided with a separate capacitor element which means that it has been necessary to separate the legs in the cup. Now it is possible to use two straight legs passing through both the cup and the narrower part of the casing. The space above the capacitor is preferably filled with a sealing compound to prevent moisture from entering the capacitor.

Another advantage in using a common capacitor element for the two connection legs is that the element also serves as an efficient shield against electromagnetic fields which enter the cup through the end closure 6. The capacitor element 6 is positioned in the cup by means of a solder connection 15. The solder connection can for instance be effectuated by means of tin rings with a fluxing material positioned on the outer edge and bushings of the capacitor element after which the cup is heated until the tin rings melt and flow out on the cup and the capacitor element. The solder connection 15 compensates for strain changes which may occur between the cup and the capacitor element.

I claim:

1. An electric igniter comprising:

a cylindrical casing including an externally threaded pressure resistant portion terminating at one end thereof at the base of a wider axially extending cup having an opening opposite said base;

first and second substantially straight connection legs extending from said cup portion through said threaded portions exiting a remaining end of said threaded portion;

a ferrite material circumferentially extending around that portion of said connection legs which extend through said threaded pressure resistance portion forming a bushing between said threaded pressure resistant portion and said connection legs;

a capacitor element located within said cup portion surrounding said connection legs and covering substantially all of said base portion shielding said threaded portion from radiation incident said cup opening and;

a filament connected to said connection legs external to said threaded portion whereby said filament is energized in response to an electrical current supplied by said feed wires without being energized by said incident radiation.

2. The electric igniter of claim 1 wherein a plurality of capacitor elements are included within said cup portion.

3. The electric igniter of claim 1 wherein said capacitor element is disc-shaped.

4. The electric igniter of claim 1 wherein said cup portion is filled with a moisture sealing compound.

* * * * *